US005996297A

United States Patent [19]

Keith et al.

[11] Patent Number: 5,996,297

[45] Date of Patent: Dec. 7, 1999

[54] CONNECTORS AND BRACKETS USED IN MAKING INSULATED COMPOSITE WALL STRUCTURES

[75] Inventors: David O. Keith; David M. Hansen, both of American Fork, Utah

[73] Assignee: H.K. Composites, Inc., Orem, Utah

[21] Appl. No.: 09/020,599

[22] Filed: Feb. 4, 1998

[51] Int. Cl.[6] ..... E04B 1/62; E04C 2/22

[52] U.S. Cl. ..... 52/410; 52/309.11; 52/405.1; 52/685; 52/677; 411/495; 411/456

[58] Field of Search ..... 52/404.2, 404.5, 52/405.1, 407.4, 410, 426, 309.7, 309.1, 309.11, 649.7, 649.8, 677–679, 698, 680–685; 411/495, 456, 499; 249/213, 214

[56] References Cited

U.S. PATENT DOCUMENTS

| | | | |
|---|---|---|---|
| 1,167,615 | 1/1916 | Barnes | 404/136 X |
| 1,284,734 | 11/1918 | Mailanen | 52/680 X |
| 2,412,744 | 12/1946 | Nelson | 52/682 X |
| 2,595,123 | 4/1952 | Callan | 25/154 |
| 2,645,929 | 7/1953 | Jones | 72/103 |
| 2,653,469 | 9/1953 | Callan | 72/50 |
| 2,718,138 | 9/1955 | Jones | 72/48 |
| 2,769,333 | 11/1956 | Reintjes | 72/19 |
| 2,964,821 | 12/1960 | Meehan | 25/131 |
| 3,623,289 | 11/1971 | Lowery | 52/677 X |
| 3,646,715 | 3/1972 | Pope | 52/309 |
| 3,701,228 | 10/1972 | Taylor | 52/309 |
| 4,018,023 | 4/1977 | Anderson | 52/410 |
| 4,545,163 | 10/1985 | Asselin | 52/378 |
| 4,624,089 | 11/1986 | Dunker | 52/410 |
| 4,702,053 | 10/1987 | Hibbard | 52/309.7 |
| 4,805,366 | 2/1989 | Long | 52/309.11 |
| 4,829,733 | 5/1989 | Long | 52/309.11 |
| 4,932,819 | 6/1990 | Almeras | 411/441 |
| 5,031,378 | 7/1991 | Murphy | 52/410 X |
| 5,094,057 | 3/1992 | Morris | 52/511 |
| 5,265,998 | 11/1993 | Kluser | 411/480 |
| 5,519,973 | 5/1996 | Keith et al. | 52/410 |
| 5,531,053 | 7/1996 | Hamm | 52/405.1 X |
| 5,606,832 | 3/1997 | Keith et al. | 52/410 |
| 5,673,525 | 10/1997 | Keith et al. | 52/309.11 |

FOREIGN PATENT DOCUMENTS

| | | | |
|---|---|---|---|
| 2633322 | 12/1989 | France | 52/677 |
| 2024157 | 12/1971 | Germany . | |
| 3803214 | 8/1989 | Germany | 52/698 |

OTHER PUBLICATIONS

R. Layne, Concrete–Plastic Sandwich Forms Walls Fast, Popular Science, p. 1 (Sep. 1985).

Sandwich Wall Panels for Expanded Corporate Offices and Warehouse, CI Journal, pp. 148–152 (Jul.–Aug. 1979).

P. Juhnke, Tilt–Up Panels. Possible Key to Low–Cost Concrete Houses, Concrete Construction, vol. 15, No. 5, pp. 156–157 (May 1970).

Composite Technologies Corporation product brochure for "Thermomass Building System" (1990).

Composite Technologies Corporation product brochure for "Thermomass Building System" (date unknown, but believed to be before Feb. 4, 1998).

*Primary Examiner*—Carl D. Friedman
*Assistant Examiner*—Winnie Yip
*Attorney, Agent, or Firm*—Workman, Nydegger & Seeley

[57] ABSTRACT

A connector used in forming a composite wall structure that includes two structural layers and an insulative layer. The connector secures the two structural layers together and is insulative so as to minimize the transfer of thermal energy across the insulating layer. The connector is inserted through the insulating layer during manufacturing of the wall structure. The connectors include reinforcement attaching structures for securing reinforcement material in a substantially fixed position before and during formation of the structural layers. The reinforcement attaching structures may be integrally formed on the connector or may be included on a bracket plate that is attached to the main shaft of the connector. Insertion of the connector through the insulating layer may be facilitated by an optional set of cutting structures positioned at one end of the connector, including a pointed tip, a plurality of cutting surfaces extending longitudinally from the tip, and longitudinal curved surfaces each preferably having a leading concave segment and a trailing convex segment.

22 Claims, 6 Drawing Sheets

CONNECTORS AND BRACKETS USED IN MAKING INSULATED COMPOSITE WALL STRUCTURES

BACKGROUND OF THE INVENTION

1. The Field of the Invention

The present invention relates to insulative connectors used to secure together layers of insulating and structural materials within a composite wall structure. In particular, the present invention relates to connectors and brackets for securing together an insulating layer and two structural layers made of a hardenable material and for securing a reinforcement material in position before the structural layers are formed and hardened.

2. Relevant Technology

As new materials and compositions have been developed, apparently unrelated materials have been synergistically combined to form useful composite materials. One such example is seen in the area of building and construction, in which high strength structural walls have been coated and layered with highly insulative materials which generally have relatively low structural strength. The resulting composite wall structure has high strength and is highly insulative. Conventionally, the structural component of such as a wall is built first, after which the insulating layer or sheet is attached to the structural component. Thereafter a protective cover is placed over the insulating material to protect and hide it. The insulating barrier reduces the transfer of thermal energy across the composite wall structure.

Concrete is one of the least expensive and strongest materials commonly used in the construction industry. Unfortunately, concrete, which is a mixture of hydraulic cement, water, and an aggregate such as rocks, pebbles, and sand, offers relatively poor insulation compared to many other materials. For example, a slab of concrete having an 8 inch thickness has an R value of about 0.64, while a one-inch thick panel of polystyrene has an R value of about 5.0. The R value of a material is proportional to the thermal resistance of the material and is useful for comparing the insulating properties of materials used in the construction industry.

In contrast with concrete, highly insulative materials, at least those of reasonable cost, typically offer poor structural strength and integrity. While lightweight aggregates having higher insulating ability may be incorporated within concrete to increase the insulating effect thereof, the use of such aggregates in an amount that has a dramatic effect on the insulation ability of the concrete will usually result in greatly decreased strength of the resulting structure.

It has been found that positioning at least one concrete layer adjacent to at least one insulating layer provides a composite structure that has both good insulating capability and good structural strength. One strategy for forming these composite wall structures is to position an insulating layer between two concrete layers. This technique, however, poses the risk of allowing the two concrete layers to collapse together or to separate apart during construction or subsequent use of the building. Accordingly, it is typically necessary to structurally bridge or connect the two concrete layers together. This is conventionally accomplished by using metal studs, bolts, or beams.

Because metal readily conducts thermal energy, metal studs, bolts and beams that are used to structurally bridge a pair of structural layers have the effect of significantly reducing the insulating properties of a composite wall. In particular, such metal studs, bolts, or beams provide channels through which thermal energy may be conducted. This is true even though the metal members may be surrounded by ample amounts of insulating material. Composite wall structures that use metal connecting members do not prevent heat from flowing from a relatively warm inside wall to a colder outside wall during cold weather, for example, as effectively as composite walls that do not use metal connecting members. Of course one might construct a building having no structural bridges between the inner and outer structural walls, although the result would be a building having inadequate stability for most needs.

In order to reduce thermal bridging, some have employed connector rods having a metal portion that passes through the concrete layers and a thermally insulating portion that passes through the insulating layer, e.g., U.S. Pat. No. 4,545,163 to Asselin. Others have developed connector rods made entirely from polymeric or other highly insulative materials. Examples of the foregoing include U.S. Pat. No. 4,829,733 to Long; U.S. Pat. No. 5,519,973 to Keith et al.; U.S. Pat. No. 5,606,832 to Keith et al.; and U.S. Pat. No. 5,673,525 to Keith et al. For purposes of disclosure, the foregoing patents are incorporated herein by specific reference.

In order to use a highly insulating connector to form a composite wall structure, the connector must be inserted through the insulating layer such that there is an end of the connector in each of the two structural layers. One method of inserting a connector through an insulating layer involves pre-drilling a set of holes in the positions where the connectors are to be situated. Of course, this involves an additional construction or manufacturing step, thereby increasing the amount of time needed and the overall cost of the finished product. In order to reduce the need for pre-drilled holes or to eliminate them altogether, there have been developed connector rods having a substantially pointed tip that is used to penetrate through the insulating layer. When inserting a connector rod through an insulating layer, it is desirable to reduce the amount of crushing, shearing, and other deformation of the insulating layer and to encourage the insulating layer to tightly conform to the connector rod. Otherwise, unhardened concrete may backflow around the connector rod and through the insulating layer to form a thermal bridge that reduces the insulating effectiveness of the composite wall structure.

It is well known in the construction industry that the structural properties of concrete are enhanced by embedding or otherwise positioning reinforcement materials therein. Concrete has very high compressive strength but offers relatively low tensile strength. For this reason, it is common to include high tensile strength reinforcement materials in concrete structures. The resulting reinforced concrete combines the high compressive strength of the concrete with the high tensile strength of the reinforcement materials. Such reinforcement materials typically include rebar, metal cables, wires, natural and synthetic organic fibers, metal fibers, wire mesh, and the like.

There are several ways in which composite wall structures having concrete layers may be formed. A first method involves successively forming or positioning the concrete and insulating layers in a horizontal orientation, allowing the concrete to cure, and tilting the resulting composite wall structure to a vertical position using a crane or other lifting mechanism. The need for moving the pre-formed composite wall structure can be eliminated, however, by forming the concrete layers vertically and in-place. Once such technique involves first positioning an insulating layer in an upright position. The insulating layer may have connector rods already inserted therethrough or the connector rods may be positioned at this point. A pair of temporary forms or molding structures are positioned on either side of the insulating layer. The concrete layers may then be formed on either side of the insulating layer using the forms to give the concrete layer the desired shape.

As mentioned previously, it is often desirable to include a reinforcement material in the concrete layers. However, it has proved difficult to adequately position reinforcement material in a fixed and ordered arrangement in preparation for the vertical and in-place formation of concrete panels. Reinforcement materials often do not have the stiffness and structural integrity to support themselves within the spaces between the insulating layer and the forms. Some reinforcement materials such as rebar can support themselves, although it is difficult to arrange rebar or other similar materials in an orderly and uniform fashion in preparation for pouring concrete layers in place.

In view of the foregoing, there exists a need for connectors that have the ability to secure reinforcement materials in place and in a fixed position prior to the formation and curing of a concrete structural layer.

It would be another advancement in the art if such connectors could also be molded in a single step, or using a minimal number of steps, such that manufacturing costs per unit connector are reduced.

It would be still another advancement in the art to provide connectors that have a penetrating tip that provides improved cutting and insertion through an insulating layer in order to minimize the backflow of concrete through the resulting hole, particularly in the absence of pre-drilled holes.

It would be yet another advancement in the art if such connectors were also highly insulative.

Such connectors for facilitating the manufacture of composite wall structures incorporating reinforcement structures embedded within the structural layers are disclosed and claimed herein.

SUMMARY OF THE INVENTION

The present invention is directed to connectors and brackets used in the manufacture of composite wall structures. The connectors and brackets facilitate the placement of reinforcement materials within the structural layers of the composite wall structures. In a preferred embodiment, the connectors include structures for substantially restraining motion of the reinforcement material with respect to the connectors before and during formation of the structural layers. In this manner, reinforcement materials may be easily and uniformly embedded in the structural layers. Optionally, the connectors of the invention also include cutting surfaces and a substantially pointed tip at one or both ends thereof to facilitate penetration of the connector through an insulating layer of the composite wall structure. The connectors of the invention are also preferably highly insulative so as not to form a thermal bridge through the insulating layer.

The preferred connectors of the present invention have reinforcement attaching structures, such as clevises, clips, notches, slots, hooks, pins, grooves or the like, to which reinforcement material may be attached in order to secure the reinforcement material in a substantially fixed position before concrete structural layers are formed and hardened. These reinforcement attaching structures may be positioned on either or both of the penetrating segment or the trailing segment of the connector and may be integrally formed on the connector or attached thereto depending on the intended use and desired configuration.

If the reinforcement attaching structures are positioned on the penetrating segment, they preferably comprise notches or the like that are formed into the shaft so as not to increase the diameter of the penetrating segment. If the reinforcement attaching structures are included on the trailing segment of the connector, they may comprise notches formed into the shaft or may alternatively be clips or devises that extend away from the shaft.

When the connector is used in manufacturing, for example, a composite wall structure that is vertically poured in-place, the reinforcement materials are secured by or suspended from the reinforcement attaching structures after the connector has been inserted through the insulating layer and before the concrete layers are formed. The reinforcement attaching structures prevent the reinforcement materials from being displaced or collapsing before and during formation of the concrete structural layers.

In an alternative embodiment, the reinforcement attaching structures that are used to secure the reinforcement materials may be included on a bracket plate that is manufactured separately from the connector shaft and that may be fitted onto the connector shaft after the shaft has been inserted through the insulating layer. In this manner, reinforcement attaching structures may be provided on the penetrating segment without being limited to notches or other structures formed into the shaft. The bracket plate may be snap fitted onto a groove in the penetrating segment or otherwise attached thereto. In other respects, the reinforcement attaching structures formed on the bracket plate function much as the other reinforcement attaching structures disclosed herein by substantially restraining motion of the reinforcement materials with respect to the connector shaft. The bracket plate may also serve to mechanically lock the connector into the hardened concrete material.

The connectors disclosed herein are preferably molded in a single step or in a minimal number of steps to minimize the manufacturing costs per unit connector. Preferably, the connectors are injection molded from a relatively high strength thermoplastic or thermoset resin. Accordingly, the connectors of the present invention significantly reduce the amount of thermal energy that is conducted through composite walls compared to the use of metal connectors that are common in the prior art. Likewise, the bracket plate that may be included as part of the connector may also be injection molded from the same or a similar material or may instead be formed from a metal or other suitable material.

The connectors of the invention optionally include cutting features at one or both ends. In particular, such connectors may have a pointed tip, preferably with adjacent cutting surfaces that improve the penetration of the connector through an insulating layer. Preferred cutting surfaces are typically situated on a plurality of ribs circumferentially spaced about the penetrating segment of the connector and extending longitudinally from the pointed tip. The ribs are separated one from another by a plurality of longitudinal grooves that also extend away from the pointed tip. Each longitudinal groove defines a longitudinal curved surface at the bottom thereof. Such a longitudinal curved surface includes a concave segment that extends longitudinally from the pointed tip and a convex segment that extends longitudinally from the concave segment.

When the connectors include a pointed tip and the aforementioned adjacent cutting surfaces, these features cooperate so as to reduce the crushing and shearing of the insulating material as the connector is inserted therethrough. In particular, the pointed tip pierces the insulating material while the adjacent cutting surfaces on the ribs slice through the insulating material. The combined action of the concave segment and the trailing convex segment gently push aside the insulating material after it has been pierced and cut. Thus, the penetrating segment of the connector forms an opening that closely conforms to the shaft of the connector and substantially prevents concrete from backflowing through the resulting hole and around the connector.

In view of the foregoing, it is an object and feature of the invention to provide a connector that has the ability to secure reinforcement materials in place and in a substantially fixed position prior to the formation and curing of a concrete structural layer.

It is another object and feature of the invention to provide a connector that can be molded in a single step or using a minimal number of steps such that manufacturing costs per unit connector are reduced.

It is a further object and feature of the present invention to provide a connector having a penetrating tip that allows improved cutting and insertion through an insulating layer in order to minimize the backflow of concrete through the resulting hole, particularly in absence of pre-drilled holes.

It is yet another object and feature of the invention to provide a connector that has the foregoing features and is also highly insulative.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to improved connectors used in the manufacture of composite wall structures. The connectors are used to structurally bridge a pair of structural layers that are separated by an insulating layer. The connectors prevent the structural layers from collapsing together or falling away from one another during or after construction of the wall. In addition, the connectors are preferably formed from an insulating material so as to minimize the flow of thermal energy across the insulating layer.

Preferred connectors of the present invention include one or more clips, clevises, notches, grooves, or other reinforcement attaching structures that are used to secure reinforcement material in a substantially fixed position prior to and during formation of concrete structural layers. In one embodiment, the reinforcement attaching structures are positioned on a bracket plate that is formed separately from a shaft of the connector and is snap-fitted onto the shaft. In another embodiment, the reinforcement attaching structures are integrally formed on the shaft of the connector. In either case, the reinforcement attaching structures simplify and facilitate the positioning of reinforcement materials within a concrete or other structural layer. In this manner, a composite wall structure that is highly insulative and that includes reinforcement materials embedded within one or both structural layers may be formed.

Figure 1A:
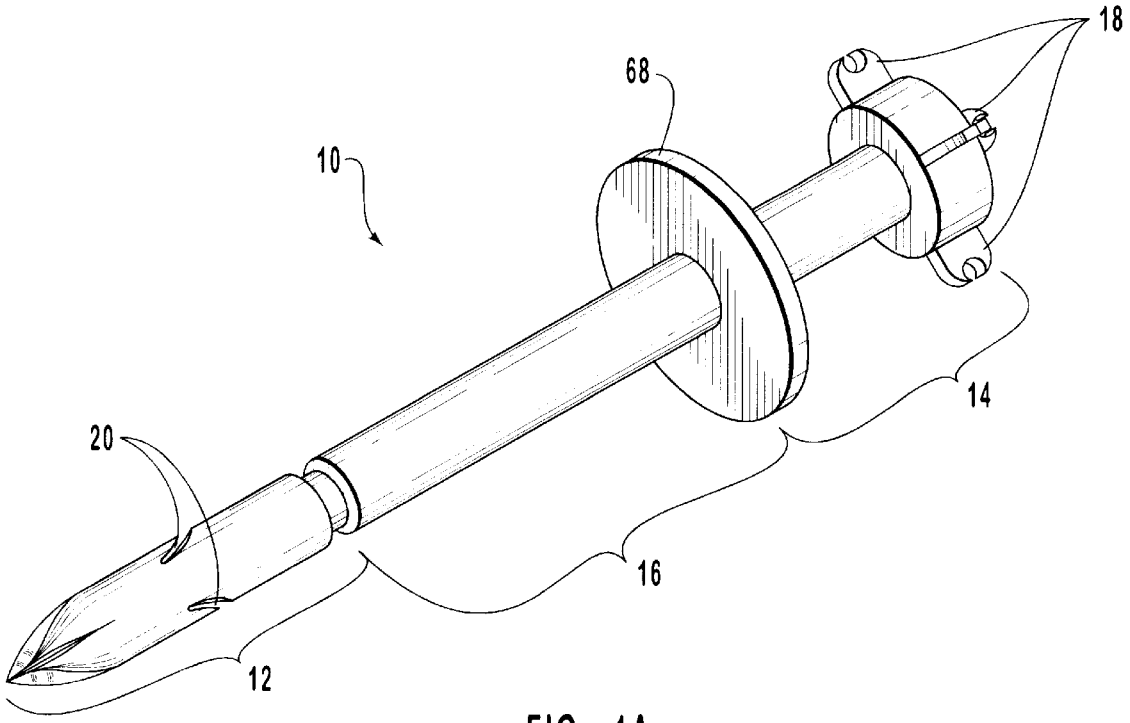
FIG. 1A is a perspective view of a connector having a plurality of devises formed on a trailing segment and a plurality of notches in a penetrating segment for use in securing reinforcement material in a substantially fixed position.
Figure 1B:
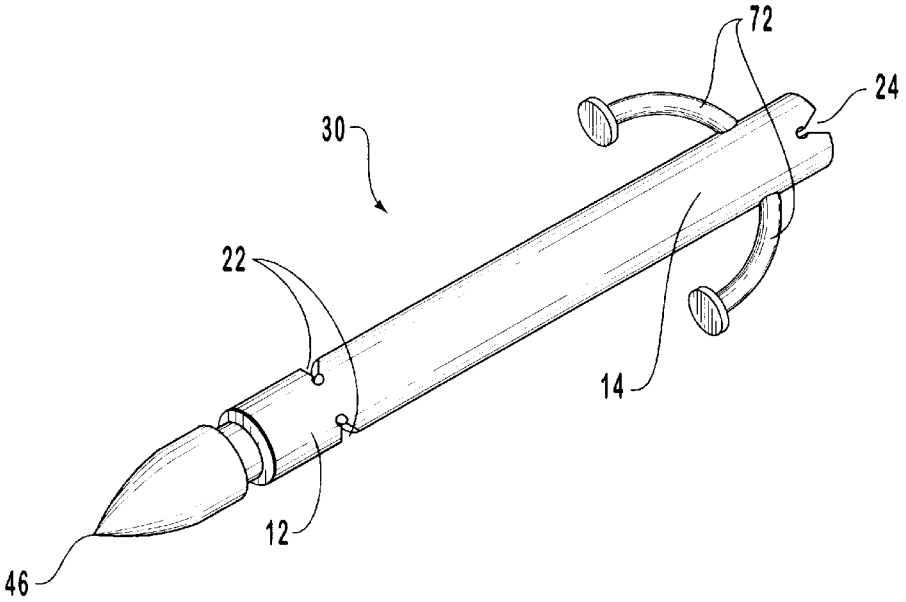
FIG. 1B is a perspective of view of another connector that has a plurality of reinforcement attaching structures for securing reinforcement material in a substantially fixed position.

FIGS. 1A and 1B illustrate connectors that include reinforcement securing means for receiving a reinforcement material and for substantially restraining motion of the reinforcement materials relative to the elongate shaft of the connector in at least one direction. It is understood in the art that the strength and other structural and mechanical properties of concrete and other hardenable materials can be enhanced by placing reinforcement materials within the hardenable material. The reinforcement materials that can be used in structural materials and that may be used in conjunction with this invention include, but are not limited to, rebar, metal cables, metal wire, metal fibers, wire netting, wire mesh, natural or synthetic fabric, natural or synthetic fibers, and combinations of the foregoing. The reinforcement securing means of the connectors disclosed herein simplify and facilitate the positioning of the reinforcement material during the manufacturing or construction process.

Before discussing specific examples of reinforcement securing means, it should be pointed out that the particular configuration of reinforcement attaching structures is often less important than the function thereof. Accordingly, it will be understood that the examples disclosed in FIGS. 1–6 are presented for illustrative purposes and not by way of limitation, and other structures may be suitable, depending on the nature of the reinforcement materials and other factors, in order to provide the function of securing refinement structure to the connectors used in making composite wall structures.

The reinforcement attaching structures may take the form of clevises, clips, notches, slots, hooks, pins, grooves, and the like. Thus, the invention contemplates connectors that have any reinforcement attaching structures by which reinforcement material may be secured in a substantially fixed position relative to the one or more connectors to which such reinforcement attaching structures are secured. Preferably, the reinforcement attaching structures are configured to substantially restrain motion of reinforcement materials in at least one direction. For example, a preferred connector under the invention includes a reinforcement attaching structure that can engage a reinforcement material so as to substantially restrain motion thereof in a longitudinal direction, or in other words, the direction that is defined by the longitudinal axis of the elongate shaft of the connector. Of course, this function can be performed by any suitable structure integrally formed on the connector shaft or attached thereto, which is adapted to prevent the reinforcement material from collapsing under its own weight, from falling away from the insulating layer, or from otherwise being displaced from a desired position within the structural layer which is to be formed. Maintaining the reinforcement material substantially fixed in the longitudinal direction tends to keep the reinforcement material substantially fixed at a desired distance from the insulating layer so that it is thereby embedded within the later-formed structural layer at a desired depth.

In many applications, it is even more preferable to provide reinforcement attaching structure which substantially restrains motion of reinforcement material, not only in the longitudinal direction, but also in a transverse direction, or in other words, in a direction perpendicular to the longitudinal axis of the elongate shaft of the connector. In the case of vertically oriented reinforcement materials, such as may be used in the cast-in-place method, maintaining the reinforcement materials fixed in a transverse direction keeps the reinforcement material suspended vertically in a desired orientation and/or fixed so that it does not substantially move from side to side. Of course, in some cases some movement, if only temporary, may be desirable in order to adjust the reinforcement material in a desired orientation in space.

It will be appreciated that, depending on the desired use of the composite wall structure, the structural properties thereof, and the nature of the reinforcement material, it may be preferable to pre-stress the reinforcement material, or alternatively, it may be preferable to allow some degree of play within the reinforcement material. The reinforcement attaching structures may be adapted, and the invention may be practiced with either case.

FIG. 1A illustrates connector 10 which comprises an elongate central shaft that preferably has a circular or elliptical cross-section and that includes a penetrating segment 12, a trailing segment 14, and a mesial segment 16 therebetween. The penetrating segment is herein defined as the portion of a connector that penetrates and then extends beyond an insulating layer and is substantially covered by a first structural layer when the connector is used to form a composite wall structure. The trailing segment is herein defined as the portion of a connector that remains uninserted into or through an insulating layer and that is substantially covered by a second structural layer when the connector is used to form a composite wall structure. The mesial segment is herein defined as the portion of a connector that is disposed substantially within an insulating layer when the connector is used to form a composite wall structure. The manner in which a connector and the penetrating, trailing, and mesial segments are disposed within a composite wall structure is to be disclosed in further detail hereinafter.

An example of the reinforcement securing means is seen in FIG. 1A in which a plurality of devises 18 are integrally formed on connector 10. The devises 18 are formed on trailing segment 14 such that reinforcement material may be attached thereto in preparation for applying concrete that is in a flowable and unhardened state. For example, devises 18 can be used to prevent a welded wire mesh from collapsing under its own weight or from being pushed aside when the concrete mixture is introduced or can be used to uniformly space rebar throughout a structural layer.

The example of reinforcement securing means of connector 10 further includes notches 20 that are provided on penetrating segment 12 in order to allow reinforcement material to be attached thereto. Notches 20 are preferably formed into penetrating segment 12 so as to not substantially increase the diameter of penetrating segment 12. If notches 20 were to protrude too much they could cause tearing and enlargement of the hole through the insulating layer, which could cause concrete to backflow through the damaged insulating layer to form an undesirable thermal bridge between the structural layers. For this reason, features such as notches 20 are preferably used on penetrating segment 12 instead of protruding reinforcement attaching structures, such as clevises. Notches 20 function in much the same manner as devises 18, with the reinforcement material being grasped and held in a substantially fixed position in preparation for forming a structural layer of hardenable material. Any attaching structure capable of attaching reinforcement structure without substantially damaging the insulating layer can be used, however, and be within the scope of the present invention.

By way of example, FIG. 1B illustrates alternative structures for securing reinforcement materials in a substantially fixed position. In particular, a connector 30 has slots 22 and 24 which function as the reinforcement securing means.

In FIGS. 1A and 1B, the securing means are capable of substantially restraining a reinforcement material at least in the longitudinal direction. Moreover, depending on the rotational orientation of the connectors, the securing means may also restrain the reinforcement material in one or more transverse direction as well.

Figure 2A:
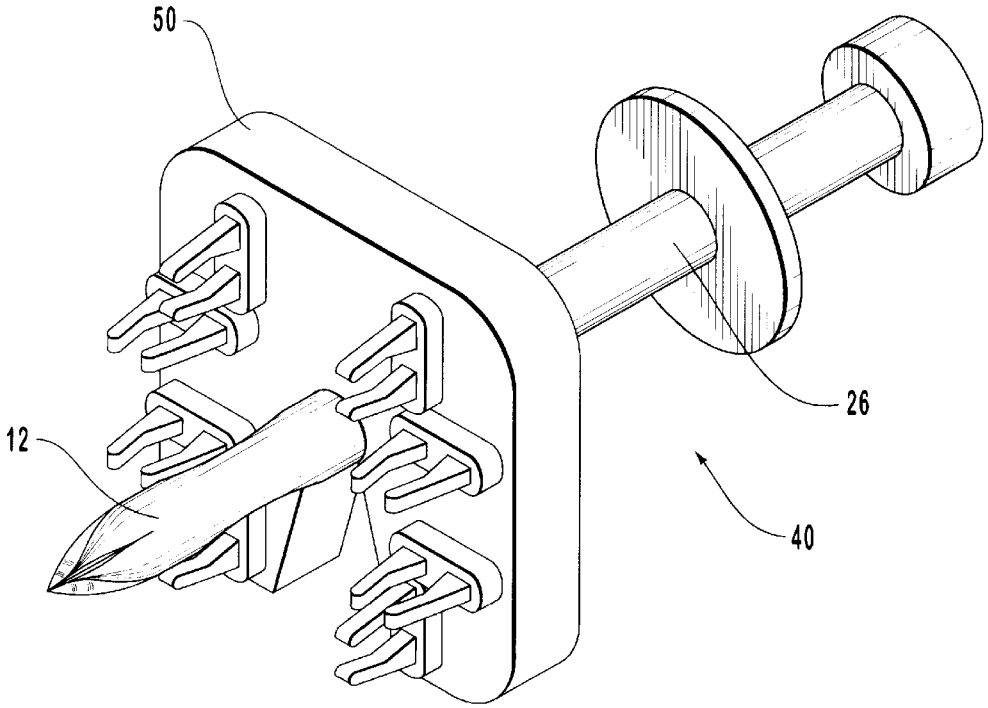
FIG. 2A is a perspective view of a connector having a bracket plate, including a plurality of clevises, that is fitted onto the penetrating segment.
Figure 2B:
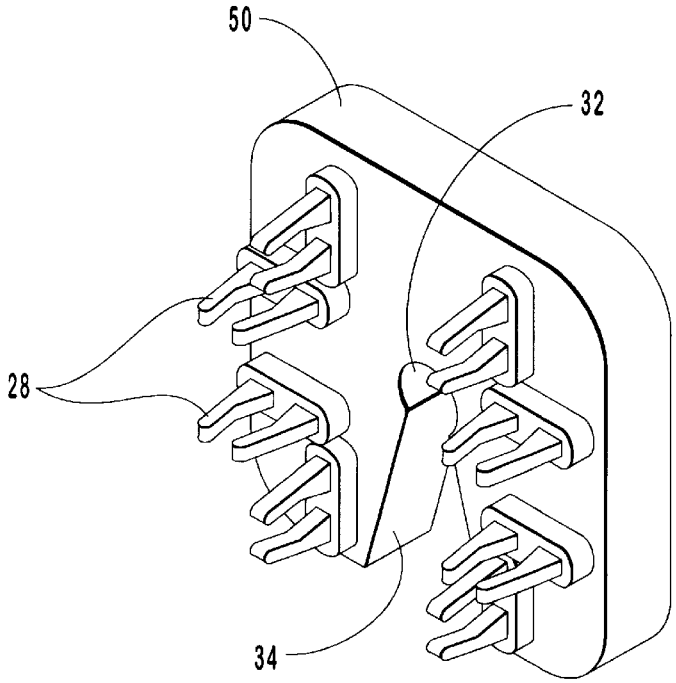
FIG. 2B is a front perspective view of the bracket plate of FIG. 2A, showing an example of reinforcement attaching structures used for securing reinforcement material in a substantially fixed position according to the invention.
Figure 2C:
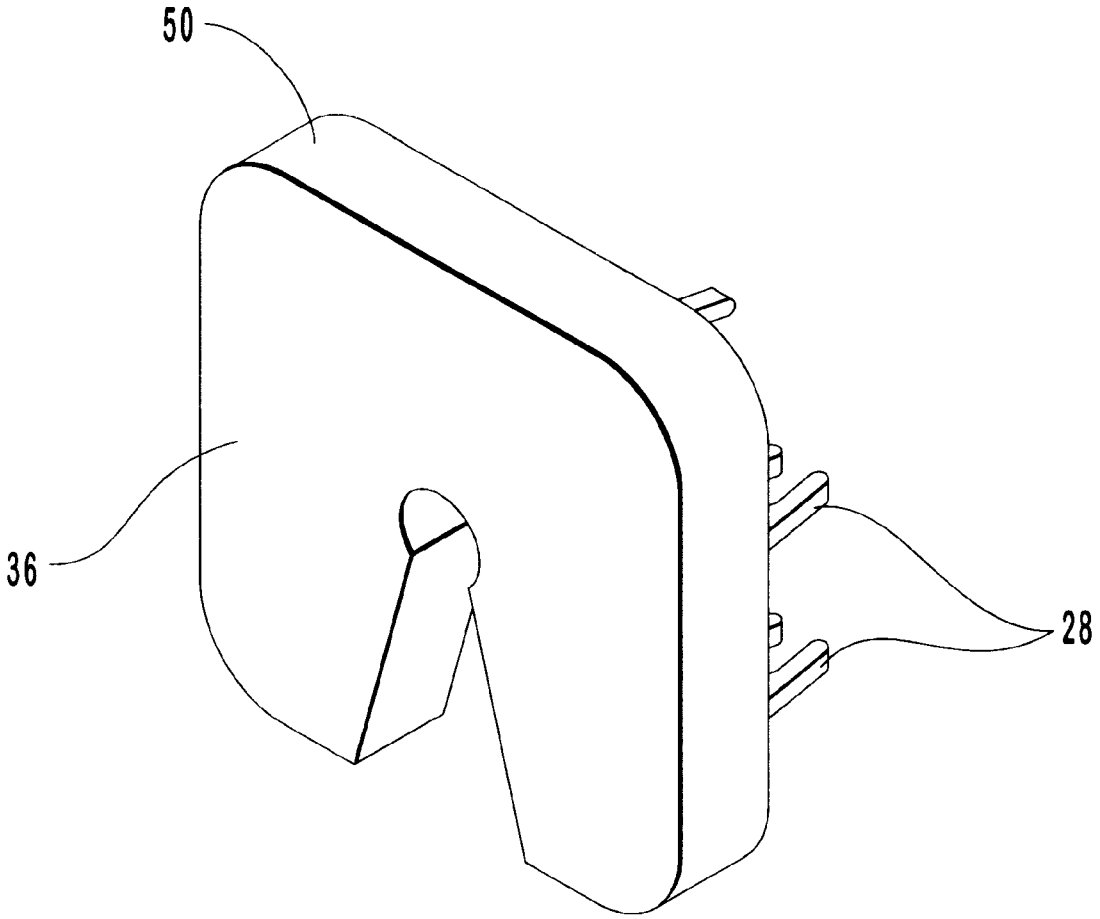
FIG. 2C is a rear perspective view of the bracket plate of FIG. 2A.

Another embodiment of the connector according to the present invention is illustrated by way of example in FIGS. 2A–2C. FIG. 2A illustrates a connector 40 that includes an elongate shaft 26 and a separately formed bracket structure 50. Bracket structure 50 is another example of reinforcement securing means. It can be seen that bracket structure 50 provides devises or other reinforcement attaching structures that extend beyond the radius of penetrating segment 12. Because bracket structure 50 is formed separately from elongate shaft 26 and is attached to penetrating segment 12, elongate shaft 26 can be inserted through an insulating layer before bracket structure 50 is secured in position to connector 40, thereby preventing tearing or other damage to the insulating layer.

Bracket structure 50 is typically used when a composite wall structure is formed vertically and in place, whether by pouring unhardened concrete into forms or other mold structures, or by "shotcrete" manufacturing techniques that do not use forms. Bracket structure 50 is presently considered particularly advantageous when used in combination with connectors having a pointed tip on each end (not shown), such as those disclosed in U.S. Pat. No. 5,673,525 to Keith et al.

FIGS. 2B and 2C illustrate a preferred configuration of bracket structure 50. As illustrated, bracket structure 50 includes reinforcement attachment means for attaching reinforcement material thereto and for substantially restraining motion of the reinforcement material relative to the bracket structure 50. Clevises 28 that are arrayed over a surface of bracket structure 50 are but one example of such reinforcement securing means. Of course, as in other embodiments of the invention, the devises could be replaced with other reinforcement attaching structures such as clips, notches, or the like. Clevises 28 operate in much the same fashion as devises 18 that have been disclosed herein in reference to FIG. 1A. As illustrated by example in FIG. 2C, bracket structure 50 may have a substantially planar surface 36 on a side thereof opposite the side that has devises 28. Substantially planar surface 36 may abut an insulating layer when bracket structure 50 is used to form a composite wall structure in order to help lock the connector in place, thereby acting as a depth limiting flange as either side of the insulating layer.

While bracket structure 50 is illustrated as having substantially planar surface 36, this is not necessary, and any bracket structure capable of securing reinforcing attaching structures to a connector is within the scope of the present invention. Nevertheless, brackets that are substantially planar are preferred in order to provide smooth abutment with an insulating layer, e.g., for spacing purposes.

Bracket structure 50 further includes shaft connection means for connecting the bracket plate to the connector shaft, one example of which is gripping surface 32. The shaft connection means ensures that the bracket plate and the attached reinforcement materials are secured in a substantially fixed position relative to the elongate shaft. The preferred method of attaching bracket structure 50 to elongate shaft 26 is conducted after penetrating segment 12 has been inserted through an insulating layer, at which point, bracket structure 50 is brought into proximity to elongate shaft 26 such that penetrating segment passes through notch 34. Force is applied to bracket plate sufficiently to cause gripping surface 32 to slide over penetrating segment 12. Because elongate shaft 26 is preferably made of a resilient and somewhat deformable material, elongate shaft 26 slightly deflects inward as gripping surface 32 is snapped thereover. When gripping surface 32 is in place, the material of elongate shaft 26 rebounds to form a press fit onto gripping surface 32. If bracket structure 50 is likewise made of a resilient material, gripping surface 32 can be deformed to a certain degree as well in order to facilitate placement of bracket structure 50 onto penetrating segment 12.

Figure 4A:
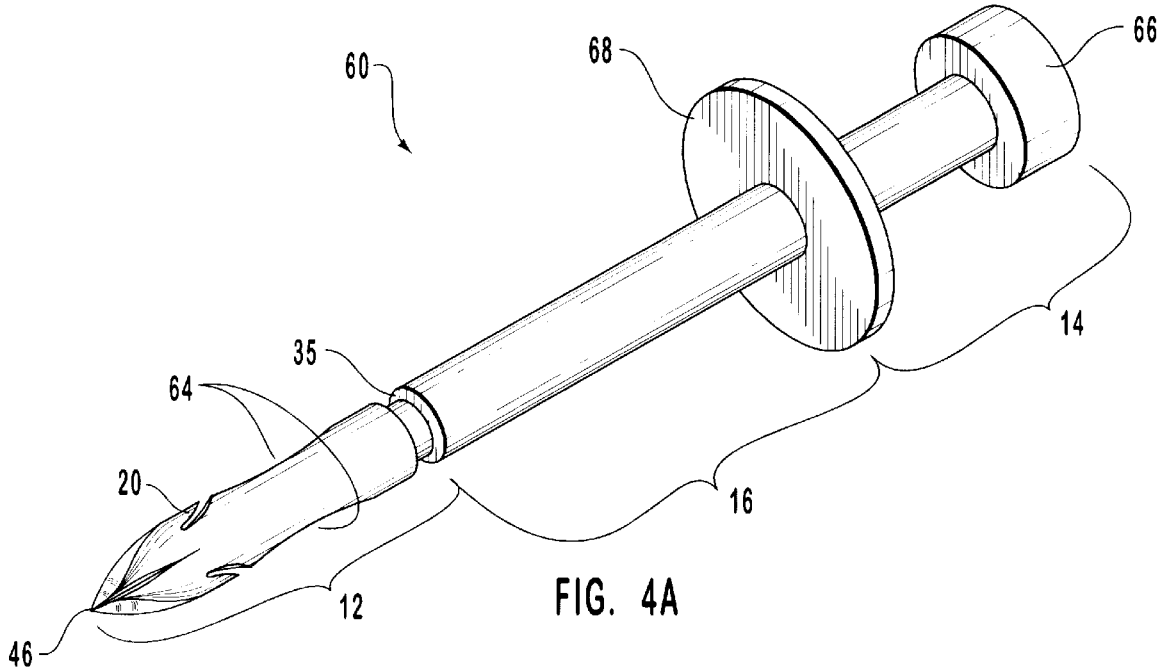
FIG. 4A is a perspective view of a connector according to the present invention, in which the connector has a penetrating segment with a plurality of cutting surfaces radiating away from a pointed tip.

By way of example, gripping surface 32 may be fitted into a groove on the surface of penetrating segment 12 such as groove 35 illustrated on connector 60 of FIG. 4A. Such a groove may extend completely or partially around the circumference of the connector shaft. The use of a groove further restricts the motion of bracket structure 50 after it has been fitted onto elongate shaft 26.

Bracket structure 50 may be formed from a resin material such as those that are disclosed hereinafter for use in the connector shafts. However, it is acceptable to use a material that is not highly insulative because bracket structure 50 is to be positioned to the side of an insulating layer and therefore cannot form a thermal bridge therethrough. Thus, bracket structure 50 may be constructed of a metal, ceramic, noninsulating plastic or any other suitable material so long as it provides suitable mechanical properties. Furthermore, the bracket plates according to the invention may be adapted for use with conventional connectors in addition to the connectors specifically disclosed herein, such as those disclosed in U.S. Pat. No. 4,545,163 to Asselin and U.S. Pat. No. 4,829,733 to Long, which are incorporated herein by specific reference.

Figure 3A:
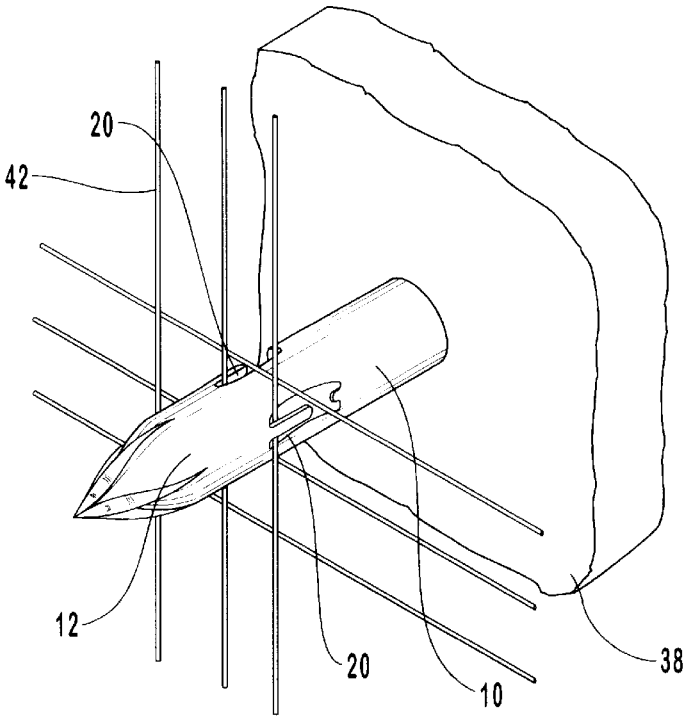
FIG. 3A is a perspective view of a connector that has engaged a reinforcement material in order to secure it in a substantially fixed position.
Figure 3B:
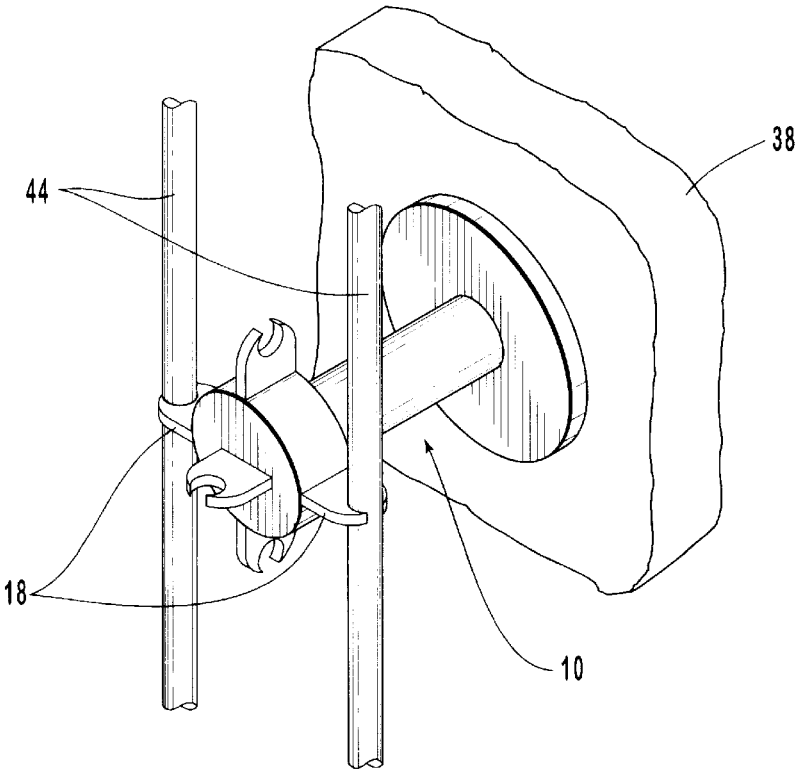
FIG. 3B is a perspective view of a connector that has engaged a reinforcement material in order to secure it in a substantially fixed position.

FIGS. 3A and 3B more particularly illustrate how reinforcement material may be attached to the inventive connectors of the present invention. FIG. 3A depicts the use of a connector for securing a reinforcement material in a substantially fixed position to penetrating segment 12 during an intermediate step of constructing a composite wall structure. In particular, connector 10 is shown having been inserted through insulating layer 38, but without a structural layer being formed over penetrating segment 12. Reinforcement material, which in this example is a welded wire mesh 42, has been engaged or hooked in notches 20 that are formed into penetrating segment 12. In this manner, wire mesh 42 is supported or suspended in a substantially fixed position prior to and during subsequent forming of a structural layer thereover.

FIG. 3B shows connector 10 having been positioned in an insulating layer 38 during an intermediate step of forming a composite wall structure, with the trailing segment protruding from the rear of the insulating layer. A reinforcement material, which is illustrated in this case as rebar 44, is grasped by devises 18. Rebar 44 or other relatively rigid reinforcement materials are typically held in place by devises 18 after being snapped in place in the desired location after the connectors are inserted through the insulating layer and before the structural layers are formed. The resilient resin or other material used to form devises 18 and other parts of the connectors of the invention is typically able to temporarily deform to permit the reinforcement material to be positioned at the desired location and to subsequently regain its former shape to firmly grasp the reinforcement material.

The connectors of the invention optionally have cutting features, which may include a plurality of cutting surfaces or edges radiating away from a pointed tip on the penetrating segment. Such cutting surfaces facilitate insertion of the connector through an insulating layer. The cutting features may also include a plurality of grooves formed between the cutting surfaces. Each groove defines a longitudinal curved surface that extends away from the pointed tip. The curved surface advantageously begins with a concave segment at or near the pointed tip and transforms into a convex segment that gradually merges with the main portion of the connector shaft. The longitudinal curved surface further facilitates penetration of the pointed tip and the connector through the insulating layer.

Figure 4B:
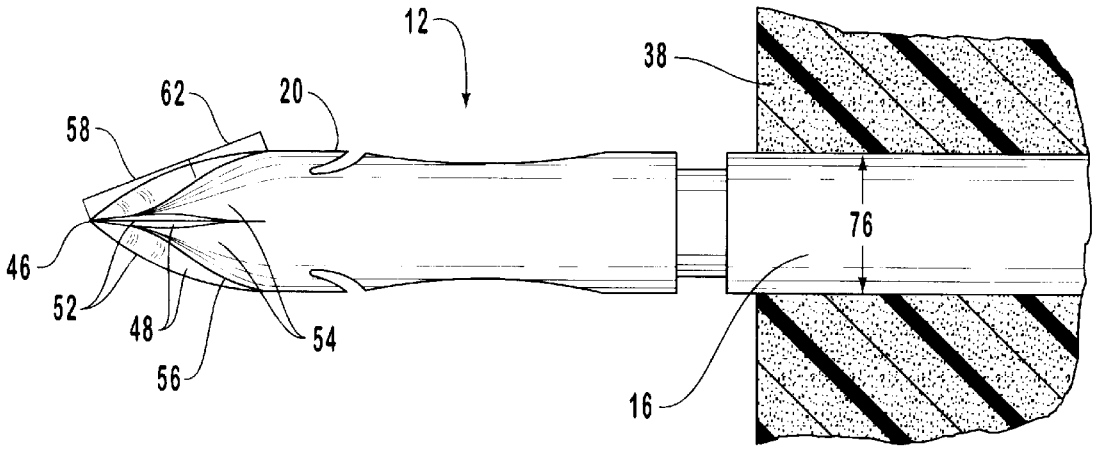
FIG. 4B is a partial side view the penetrating segment of the connector of FIG. 4A, showing in greater detail the pointed tip, the cutting surfaces, and longitudinal curved surfaces in the grooves separating the cutting surfaces.
Figure 4C:
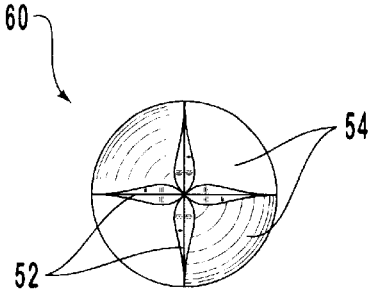
FIG. 4C is an end view of the connector of FIG. 4B, illustrating the relative positioning of the cutting surfaces, the pointed tip, and the longitudinal curved surfaces.

An example of cutting surfaces that radiate away from the pointed tip may be seen in reference to FIGS. 4A–4C. FIG. 4B illustrates connector 60 that has a substantially pointed tip 46 at an end of penetrating segment 12. A plurality of circumferentially spaced ribs 48 extend longitudinally from the pointed tip 46. Each rib 48 has a cutting surface 52 positioned on a crest thereof. Preferably, cutting surface 52 is a blade-like edge that is sharp enough to cut through insulating material. Penetrating segment 12 also has a plurality of longitudinal grooves 54 that separate adjacent ribs 48, whereby a longitudinal curved surface 56 is defined at the bottom of each groove 54. In FIG. 4B, the profile of the longitudinal curved surface 56 is shown to include a substantially concave segment 58 and a substantially convex segment 62. In particular, curved surface 56 may have a concave segment 58 that extends longitudinally from pointed tip 46 and transforms into a convex segment 62. Furthermore, convex segment 62 may gradually merge with the main portion of penetrating segment 12.

Pointed tip 46, cutting surfaces 52, and curved surfaces 56, when included in the connectors of the invention, operate together to allow penetrating segment 12 to be inserted through an insulating layer 38 while minimizing the amount of crushing, tearing, and other deformation of insulating layer 38. It can be appreciated that pointed tip 46 pierces insulating layer 38 while cutting surfaces 52 that radiate away from and trail from pointed tip 46 slice through insulating layer 38. At the same time, the concave segment 58 and convex segment 62 of curved surface 56 gently push to one side the material from insulating layer 38 that has been pierced and cut. In this manner, hole 76 that is formed in insulating layer 38 by penetrating segment 12 has a diameter that is very nearly equal to the diameter of penetrating segment 12 and mesial segment 16.

Depending on the resiliency of the particular insulating material that is used, insulating layer 38 may rebound such that hole 76 tightly conforms to mesial segment 16. In any event, the penetrating segment 12 that is disclosed herein forms a hole in an insulating layer that eliminates gaps that might otherwise be formed between insulating layer 38 and mesial segment 16. Accordingly, concrete or other hardenable material that is subsequently formed over penetrating segment 12 is substantially prevented from backflowing through hole 76 within insulating layer 38 in order to prevent formation of undesired thermal bridges.

FIG. 4C depicts connector 60 viewed frontally along the longitudinal axis thereof. While connector 60 of FIG. 4C preferably has four cutting surfaces 52 and four longitudinal grooves 54, more or fewer of each may be advantageously used according to the present invention.

Connectors that have cutting surfaces 52 and curved surfaces 56 are particularly useful for a variety of applications that include, but are not limited to, forming a composite wall structure in precast, pre-stressed, tilt-up, modular precast, or cast or poured in-place methods, or in "shotcrete" processes that do not use forms. A "tilt-up" method is one in which a structural wall is formed with a horizontal orientation and is tilted into a vertical position after the structural layers have hardened. Cast or poured in-place refers to methods in which an insulating layer is positioned vertically and between forms. The connectors are inserted through the insulating layer either before or after it is positioned vertically. The concrete or other hardenable mixture is subsequently poured between the insulating layer and the forms. "Shotcrete" refers to a concrete or similar material that is sprayed or otherwise projected onto an exposed insulating layer. A shotcrete method of forming an insulating wall is conducted without forms, since the shotcrete material adheres to and conforms with the insulating layer and the connector.

FIGS. 4A–4C further illustrate various optional features of connectors that, while not being necessary to practice the invention, are often advantageous, depending on the particular composite structural wall that is to be formed. For example, because connector 60 is typically intended to be used to secure together two hardenable structural layers, there is preferably included thereon means for mechanically locking connector 60 within a structural layer. An example of such means may be seen at recesses 64, which are localized reductions in the diameter of penetrating segment 12. It can be understood that concrete or other hardenable material will flow into recesses 64 and prevent penetrating segments 12 from being retracted from, or shifted further into, the structural layer after hardening.

Another example of such means is seen at knob 66 and annular stop 68, which together act to restrain the motion of connector 60 in relation to a structural layer formed thereover. In addition, annular stop 68 abuts an insulating layer when connector 60 is inserted therethrough and prevents further penetration of connector 60. The means for mechanically interlocking connector 60 to structural layers is not limited to those features 64, 66, and 68 illustrated in FIG. 1A, but may instead be any other structure by which penetrating segment 12 and trailing segment 14 may be held within a hardened structural material. Moreover, winged or arcuate stops 72, as seen in FIG. 1B, may replace annular stop 68.

Of course, the invention may be practiced without some or all of the foregoing features illustrated in FIGS. 4A–4C, so long as the connector includes some structure for securing reinforcement material in a substantially fixed position relative to the connector in at least one direction.

In order to minimize the transfer of thermal energy across the insulating layer and through the composite wall structure, the connectors are preferably formed from a relatively highly insulative, or high R value, thermoplastic or thermoset material. One thermoplastic material that is presently preferred is polyphenylsufone resin, due to its excellent resistance to chemical attack and heat resistant characteristics. Another preferred thermoplastic material is a polyphthalimide, which is less expensive than polyphenylsulfone resins but somewhat less heat resistant. Other preferred thermoplastic materials include polyamides, polyarylsulfones, polycarbonates, polyphthalamides, polysulfones, polyphenylsulfones, polyethersulfones, and aliphatic polyketones. Less preferred thermoplastics that are nevertheless adequate for most applications include acrylics, polyethylene, polypropylene, acrylonitrile-butadiene-styrene copolymers, polyfluorocarbons, polybutadienes, polybutylene teraphthalates, polyesters, polyethylene teraphthalates, polyphenylene ethers, polyphenylene oxides, polyphenylene sulfides, polyphthalate carbonates, polypropylenes, polystyrenes, polyurethanes, polyvinyl chlorides, and polyxylenes.

Preferred thermoset resins include polyester and vinyl esters. Other suitable thermoset materials include diallyl phthalates, epoxy resins, furan resins, and phenolic resins. The foregoing lists are illustrative and not limiting. In addition, copolymers and alloys of the foregoing materials may be used. The criteria used to select the material include sufficient strength and flexibility in order to avoid failure, a sufficiently high R value such that the composite wall structure is adequately insulative, cost, and moldability.

Depending on the particular plastic or resin used to form the connector and the desired structural properties of the finished product, reinforcing fibers such as glass fibers, carbon fibers, boron fibers, ceramic fibers, cellulosic fibers, nylon fibers, other polymeric fibers and the like may be interspersed within the material in order to increase the tensile strength, bending strength, toughness, and shear strength of the connectors. Fibers are preferably not included for cost considerations if the connectors have adequate strength in their absence.

The connectors of the invention are preferably formed by injection molding in a single step or, alternatively, by a small number of steps that preferably include an injection molding step. Optionally, the injection molding step may be replaced by resin transfer molding, reaction injection molding, or any other single-step or relatively simple molding process. An important criterion is that the costs of the molding process be commensurate with the overall cost parameters of the connector that is to be formed. Using injection molding of resins or plastics provides connectors having adequate tensile, shear, and bending strength, and has the benefit of being relatively cost-effective. In contrast, other available methods of manufacturing such as pultrusion are not as favored, due to the high cost of the subsequent machining steps that are frequently necessary. However, pultrusion can be employed if cost effective for a given connector design.

Figure 5:
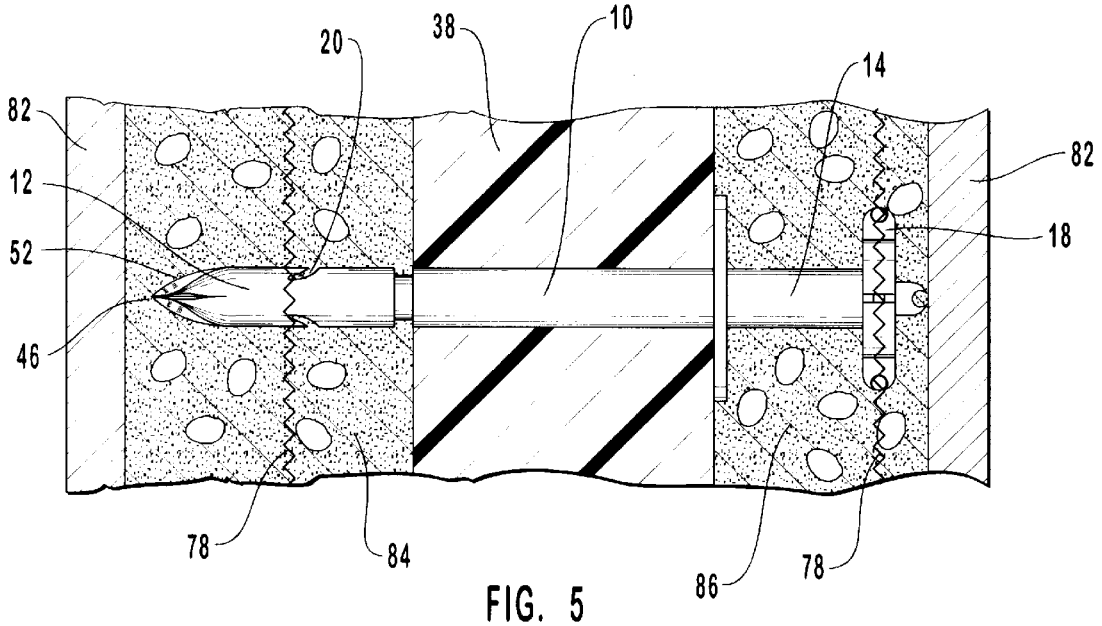
FIG. 5 is a cross-sectional view of a composite wall structure formed according to the invention, including a connector, reinforcement materials, an insulating layer, and structural layers.

The method of forming a composite wall structure by using a connector according to the present invention may be understood by reference to FIG. 5. In particular, FIG. 5 illustrates a composite wall structure that is formed according to a method that involves pouring concrete vertically and in-place between an insulating layer and forms. The first step includes providing an insulating layer 38 and positioning it vertically upon a footing. The insulating layer may be formed from a highly insulative material that can be used in construction applications. Preferably, the highly insulative material is able to be penetrated by a sharp object such as the connectors disclosed herein using only manual force or by using manually operated tools. Examples of suitable insulative materials include, but are not limited to, polystyrene foam, fiberglass, aerogel, xerogel, xonotlite, seagel, polyisocyanate foam, polyurethane foam, urea-formaldehyde foam, insulating cementitious materials, and mixtures of the foregoing.

A plurality of connectors 10 are inserted through insulating layer 38 either before or after it has been positioned vertically. The number and spacing of connectors 10 depends on the structural properties of the hardenable material and the intended use for the finished composite wall structure. However, in typical construction applications, it has been found that providing spacing of about 40 cm between laterally adjacent connectors 10 is sufficient to result in an acceptably secure and strong structural wall.

Connectors 10 may be positioned by forming in insulating layer 38 a series of pre-drilled holes located where the connectors are to be inserted. However, the pointed tip 46 nd the cutting surfaces 52 of the inventive connector 10 allow insertion thereof without pre-drilled holes in many cases. During insertion, annular stop 68 makes contact with insulating layer 38 and causes connector 10 to be inserted to the proper depth by preventing further penetration. At this point, reinforcement material 78 is secured to connector 10 by means of notches 20 in penetrating segment 12 and devises 18 in trailing segment 14. Insulating layer 38 is positioned vertically at this stage of the method. Forms 82 are then situated at both ends of connector 10 so as to be parallel with insulating layer 38 as seen in FIG. 5. The ends of the connector may or may not abut the surface of the form, although abutment helps keep the insulation layer properly spaced. By means of illustrating only, FIG. 5 depicts abutment by the end of the trailing segment but not of the penetrating segment. In many cases, it may be preferable for the penetrating segment to abut the forms 82 as well. In this and other cases, the trailing segment may not abut the forms 82.

Next, first layer 84 and second layer 86 of hardenable material are formed on either side of insulating layer 38 and inside the corresponding form 82. In a preferred embodiment, the hardenable material is a concrete mixture including a hydraulic cement binder, waters an aggregate material and other appropriate admixtures. Concrete is preferred because of its low cost, high strength and ease of casting compared to other materials. Nevertheless, any appropriate structural material may be used, such as high strength polymers, resins or other materials which can flow when cast and later be hardened. Although in ordinary circumstances reinforcement material 78 is adequate, in some instances it may be desirable to include additional reinforcement within the hardenable material. For example, plastic, glass, graphite, and steel particles and fibers may be dispersed throughout the hardenable mixture without being attached to connectors 10. In addition, rebar, wire and other reinforcements can be used which are not attached to connectors 10.

Because the hardenable material is applied while still in a substantially fluid state, first layer 84 substantially covers penetrating segment 12 and second layer 86 likewise substantially covers trailing segment 14. Depending on the consistency of the concrete mixture, the dimensions of the wall, and the nature of the reinforcement material and the reinforcement attaching structures, the concrete mixture may need to be vibrated, poked, or otherwise consolidated in order to encourage it to adequately conform to the irregularities of the connector and the reinforcement material.

Preferably, the only portion, if any, of penetrating segment 12 and trailing segment 14 that remains exposed after formation of first and second layers 84 and 86 is a tip or other small surface area at an end thereof such as pointed tip 46. It can be seen that first layer 84 and second layer 86 encase the reinforcement material 78. The hardenable material of first layer 84 and second layer 86 is next allowed to cure and harden in order to transform first layer 84 into a first structural layer and second layer 86 into a second structural layer. At this point, forms 82 may be removed from the structural layers. For aesthetic purposes, a hard surface layer (not shown) can be applied to the exposed surfaces of first and second structural layers 84 and 86 by spraying, troweling, or application with a high pressure nozzle, or the exposed surfaces of first and second structural layers 84 and 86 can be smoothed or textured.

An alternative method of forming a composite wall structure involves erecting an insulating layer 38 such as that seen in FIG. 5. Again, connectors 10 are inserted through insulating layer 38, and reinforcement materials 78 are fastened onto devises 18 and notches 20. In this embodiment, however, forms 82 are omitted. Instead, a hardenable material, such as "shotcrete" is sprayed or otherwise projected onto both sides of insulating layer 38. The shotcrete adheres to insulating layer 38 and readily conforms to the irregularities of connector 10 and reinforcement material 78. In many applications, this method may be preferable to using forms and pouring the concrete mixture, since shotcrete, which typically has relatively small-sized aggregates, may conform more easily to the connector 10 and reinforcement material 78.

Figure 6:
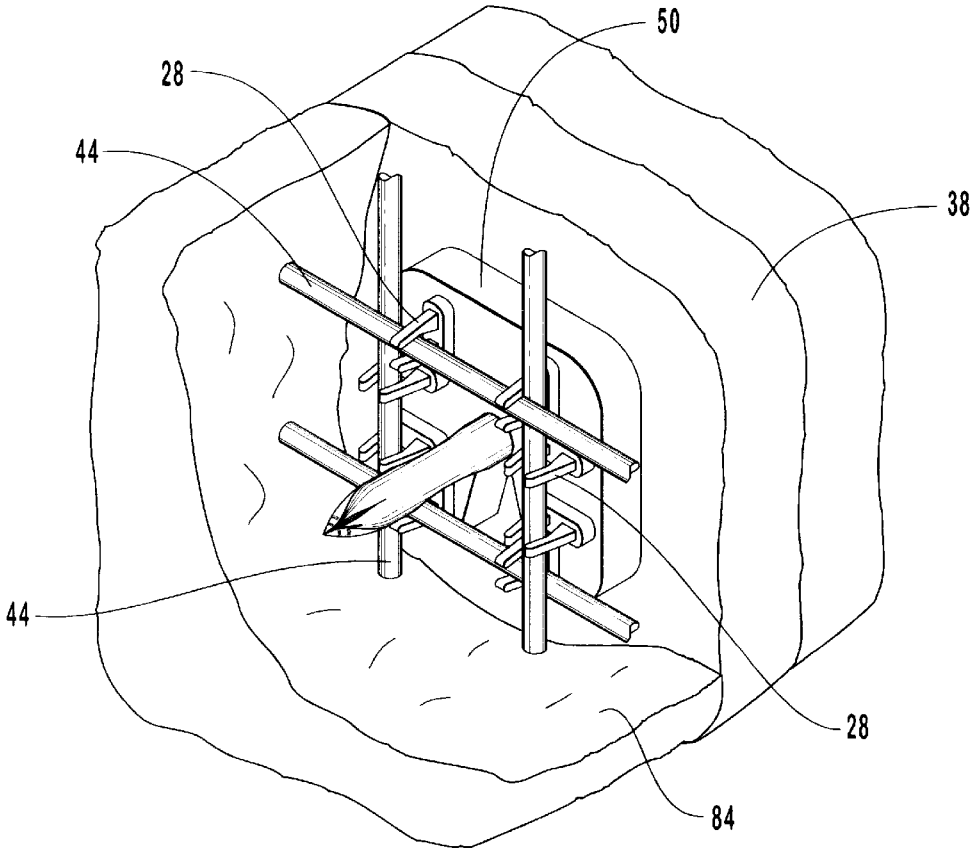
FIG. 6 is a breakaway perspective view of a composite wall structure formed according to the invention, in which a bracket plate is used to secure a reinforcement material.

A composite wall structure that uses bracket plate 50 in combination with a connector of the present invention is depicted in FIG. 6. Bracket plate 50 has been positioned on penetrating segment 12 of the connector such that its substantially planar surface abuts or is proximate insulating layer 38. As is illustrated, reinforcement material 44 has been snapped into place on devises 28 prior to formation of structural layer 84. In the example shown in FIG. 6, reinforcement material 44 consists of rebar. In other respects, the method of forming the composite wall structure is similar to that presented in reference to FIG. 5.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A connector used in making a composite wall structure, the connector comprising an insulating material and including:

an elongate shaft having a penetrating segment, a trailing segment, and a mesial segment therebetween;

at least one recess, disposed along the elongate shaft within at least one of the penetrating segment and the trailing segment, configured so as to anchor the elongate shaft within a hardenable structural material; and at least one bracket structure removably attached to the elongate shaft, wherein the at least one bracket structure includes at least one reinforcement attaching structure selected from the group consisting of clevises, clips, notches, slots, hooks, grooves pins, and combinations thereof, the at least one reinforcement attaching structure being configured so as to receive and substantially restrain motion of a reinforcement material relative to the elongate shaft in at least one direction.

2. A connector as defined in claim 1, wherein the at least one bracket structure further comprises shaft connection means for connecting the bracket structure to the elongate shaft.

3. A connector as defined in claim 3, wherein the elongate shaft further includes one or more grooves extending at least partially around the circumference of the elongate shaft, the at least one bracket structure being configured so as to snap fit into at least a portion of one of the one or more grooves.

4. A connector as defined in claim 1, further including reinforcement securing means integrally formed in the elongate shaft and comprising at least one reinforcement attaching structure selected from the group consisting of notches, slots, hooks, grooves, and combinations thereof.

5. A connector as defined in claim 1, wherein at least a portion of the elongate shaft is formed from a resin selected from the group consisting of polyamides, polyarylsulfones, polycarbonates, polyphthalamides, polysulfones, polyphenylsulfones, polyethersulfones, aliphatic polyketones, acrylics, acrylonitrile-butadiene-styrene copolymers, polyfluorocarbons, polybutadienes, polybutylene teraphthalates, polyesters, polyethylene teraphthalates, polyphenylene ethers, polyphenylene oxides, polyphenylene sulfides, polyphthalate carbonates, polypropylenes, polystyrenes, polyurethanes, polyvinyl chlorides, polyxylenes, vinyl esters, diallyl phthalates, epoxy rosins, furan resins, and phenolic resins, copolymers of the foregoing, and combinations of the foregoing.

6. A connector as defined in claim 1, further comprising:

a substantially pointed tip at an end of the penetrating segment; and a plurality of circumferentially spaced ribs on the penetrating segment extending longitudinally from the substantially pointed tip, each of the plurality of circumferentially spaced ribs including a longitudinal cutting surface.

7. A connector as defined in claim 6, further including a plurality of longitudinal grooves on the penetrating segment between adjacent ribs of the plurality of circumferentially spaced ribs, a longitudinal curved surface being positioned on each of the plurality of longitudinal grooves, the longitudinal curved surface having a substantially concave segment extending longitudinally from the substantially pointed tip and a substantially convex segment extending longitudinally from the concave segment.

8. A connector as defined in claim 1, wherein the at least one direction comprises the direction parallel to the longitudinal axis of the elongate shaft.

9. A connector as defined in claim 1, wherein the at least one direction comprises the direction parallel to the longitudinal axis of the elongate shaft and at least one transverse direction.

10. A connector used in making a composite wall structure, the connector comprising an insulating material and including:

an elongate shaft having a penetrating segment, a trailing segment, and a mesial segment therebetween; and at least one bracket structure removably attached to the elongate shaft within at least one of the penetrating segment and the trailing segment, the bracket structure including:

reinforcement attachment means for attaching a reinforcement material to the bracket structure in a removable snap-fit connection and for substantially restraining motion of the reinforcement material in at least one direction relative to the elongate shaft; and shaft connection means for connecting the bracket structure to the elongate shaft in order to substantially restrain motion of the bracket structure relative to the elongate shaft.

11. A connector as defined in claim 10, wherein the reinforcement attachment means comprises at least one reinforcement attaching structure selected from the group consisting of clevises, clips, notches, slots, hooks, grooves, and pins.

12. A connector as defined in claim 10, wherein the shaft connection means comprises a notch in the bracket structure that mates with a corresponding groove within the elongate shaft.

13. A connector used in making a composite wall structure, the connector comprising an insulating material and including:

an elongate shaft having a penetrating segment, a trailing segment, and a mesial segment therebetween;

anchoring means, disposed along the elongate shaft within at least one of the penetrating segment and the trailing segment, for anchoring the elongate shaft within a hardenable structural material; and a plurality of clevises extending outwardly from the elongate shaft and configured so as to securely receive a reinforcement material in a removable snap fit connection and for substantially restraining motion of the reinforcement material relative to the elongate shaft in at least one direction, the clevises being positioned on at least one of the penetrating segment and the trailing segment.

14. A connector as defined in claim 13, wherein the clevises are attached to the elongate shaft by means of at least one bracket structure removably attached to the elongate shaft within at least one of the penetrating segment and trailing segment.

15. A connector as defined in claim 13 wherein the clevises are integrally formed within the elongate shaft within at least one of the penetrating segment and the trailing segment.

16. An insulating composite wall structure comprising:

a first structural layer and a second structural layer, each of which is made from a hardenable material;

an insulating layer disposed between the first structural layer and the second structural layer;

a reinforcement material embedded within at least one of the first structural layer and the second structural layer; and a plurality of connectors that connect together the first structural layer, the insulating layer, and the second structural layer, each of the plurality of connectors comprising an insulating material and including:

an elongate shall having a penetrating segment, a trailing segment, and a mesial segment therebetween;

at least one recess disposed along the elongate shaft within at least one of the penetrating segment and the trailing segment which anchors the elongate shaft within the hardenable structural material; and at least one reinforcement attaching structure positioned on at least one of the penetrating segment and the trailing segment to which the reinforcement material is initially attached in a snap fit connection.

17. An insulating composite wall structure as defined in claim 16, wherein each of the plurality of connectors further comprises:

a substantially pointed tip at an end of the penetrating segment;

a plurality of circumferentially spaced ribs on the penetrating segment extending longitudinally from the substantially pointed tip;

a longitudinal cutting surface on each of the plurality of circumferentially spaced ribs; and a plurality of longitudinal grooves on the penetrating segment between adjacent ribs of the plurality of circumferentially spaced ribs.

18. An insulating composite wall structure as defined in claim 16, wherein the at least one reinforcement attaching structure is attached to the elongate shaft by means of at least one bracket structure fitted onto the elongate shaft within at least one of the penetrating and trailing segments.

19. An insulating composite wall structure as defined in claim 16, wherein the reinforcement attaching structure is integrally formed in the elongate shaft.

20. An insulating composite wall structure as defined in claim 16, wherein at least one of the first structural layer and the second structural layer comprises a concrete material.

21. An insulating composite wall structure as defined in claim 16, wherein the insulating layer comprises a material selected from the group consisting of polystyrene foam, fiberglass, aerogel, xerogel, xonotlite, seagel, polyisocyanate foam, polyurethane foam, urea-formaldehyde foam, insulating cementitious materials, and combinations of the foregoing.

22. An insulating composite wall structure as defined in claim 16. wherein the reinforcement material is selected from the group consisting of rebar, metal cables, metal wire, metal fibers, wire netting, wire mesh, natural or synthetic fabric, natural or synthetic fibers, and combinations of the foregoing.

* * * * *

UNITED STATES PATENT AND TRADEMARK OFFICE

CERTIFICATE OF CORRECTION

PATENT NO. : 5,996,297
DATED : Dec. 7, 1999
INVENTOR(S) : David O. Keith; David M. Hansen It is certified that error appears in the above-indentified patent and that said Letters Patent is hereby corrected as shown below:

Col. 1, line 25, after "such" delete "as"

Col. 4, line 7, after "or" change "devises" to --clevises--

Col. 5, line 44, after "of" change " devises" to --clevises--

Col.6, line 5, after "view" add --of--

Col. 8, line 11, after "of" change "devises" to --clevises--

Col. 8, line 12, after "The" change "devises" to --clevises--

Col. 8, line 16, after "example," change "devises" to --clevises--

UNITED STATES PATENT AND TRADEMARK OFFICE

CERTIFICATE OF CORRECTION

PATENT NO. : 5,996,297

DATED : Dec. 7, 1999

INVENTOR(S) : David O. Keith; David M. Hansen

It is certified that error appears in the above-indentified patent and that said Letters Patent is hereby corrected as shown below:

Col. 8, line 58, after "provides" change "devises" to --clevises--

Col. 9, line 16, after "the" change "devises" to --clevises--

Col. 9, line 19, before "18" change "devises" to --clevises--

Col. 9, line 22, after "has" change "devises" to --clevises--

Col. 10, line 33, after "by" change "devises" to --clevises--

Col. 10, line 35, before "18" change "devises" to --clevises--
Col. 10, line 38, after "form" change "devises" to --clevises--

Signed and Sealed this

Tenth Day of April, 2001

*Attest:*

Nicholas P. Godici

NICHOLAS P. GODICI

*Attesting Officer*

*Acting Director of the United States Patent and Trademark Office*